US008303089B2

(12) United States Patent
Kim

(10) Patent No.: US 8,303,089 B2
(45) Date of Patent: Nov. 6, 2012

(54) PRINTER INK CARTRIDGE TYPE CONNECTOR

(75) Inventor: Yong-Soo Kim, Siheung-si (KR)

(73) Assignee: Molex Incorporated, Lisle, IL (US)

( * ) Notice: Subject to any disclaimer, the term of this patent is extended or adjusted under 35 U.S.C. 154(b) by 116 days.

(21) Appl. No.: 12/675,817

(22) PCT Filed: Aug. 29, 2008

(86) PCT No.: PCT/KR2008/005087

§ 371 (c)(1),
(2), (4) Date: Aug. 23, 2010

(87) PCT Pub. No.: WO2009/028904

PCT Pub. Date: Mar. 5, 2009

(65) Prior Publication Data

US 2010/0309256 A1 Dec. 9, 2010

(30) Foreign Application Priority Data

Aug. 30, 2007 (KR) ..... 10-2007-0087693

(51) Int. Cl.
*B41J 2/14* (2006.01)
*B41J 2/16* (2006.01)
*H01R 4/48* (2006.01)

(52) U.S. Cl. ..... 347/50; 439/862

(58) Field of Classification Search ..... 347/50, 347/85, 86
See application file for complete search history.

(56) References Cited

U.S. PATENT DOCUMENTS 6,626,519 B1 * 9/2003 McAlonis ..... 347/50
2010/0136850 A1 * 6/2010 Inaba et al. ..... 439/733.1

FOREIGN PATENT DOCUMENTS

JP 11-070663 3/1999
JP 2000-208184 7/2000
JP 2002-234191 8/2002

* cited by examiner

*Primary Examiner* — Matthew Luu
*Assistant Examiner* — Renee I Wilson
(74) *Attorney, Agent, or Firm* — Timothy M. Morella

(57) ABSTRACT

Provided is an electrical connector for a print ink cartridge. The electrical connector includes a housing including a thin protrusion having a rectangle shape on one side portion thereof, a plurality of pin grooves spaced apart predetermined intervals from each in one side lower portion of the protrusion, a plurality of format ribs spaced apart predetermined intervals from each other in the other side of the protrusion, and coupling bosses having a wedge shape separately protruding on both sides of each of the ribs, a connection terminal serving as a torsion spring, the connecting terminal including a pin connector inserted into each of the pin grooves of the housing and fixed in a straight line orientation, a wound coupling insert fitted onto each of the coupling bosses to give elasticity thereto, a parallel extending from the coupling insert and along each of the ribs, a bend bent at a front end of the parallel, and a socket connector bent in a state where the socket connector is connected to the bend, the socket connector being connected to an external socket, and a cover integrally fixed to the housing by a plurality of coupling hooks disposed on the housing, the cover including pine connector grooves pressing the pin connector of the coupling terminal in a downward direction in a side surface of the cover.

6 Claims, 5 Drawing Sheets

[Fig. 1]
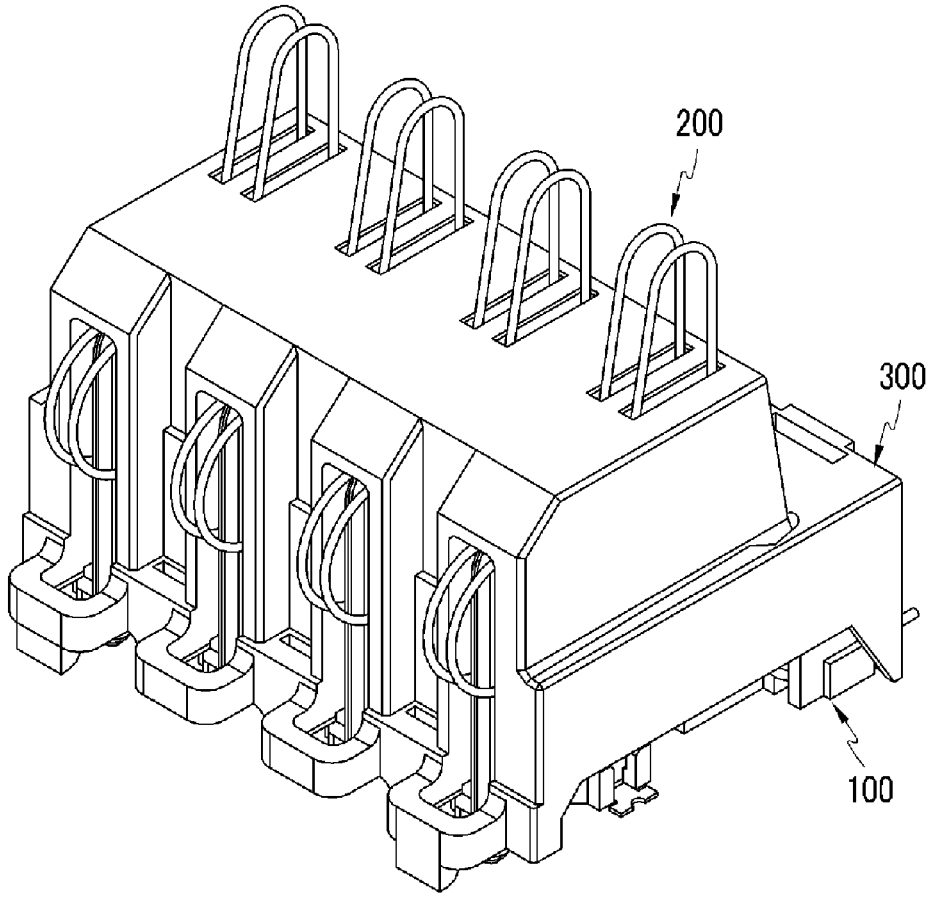

[Fig. 2]
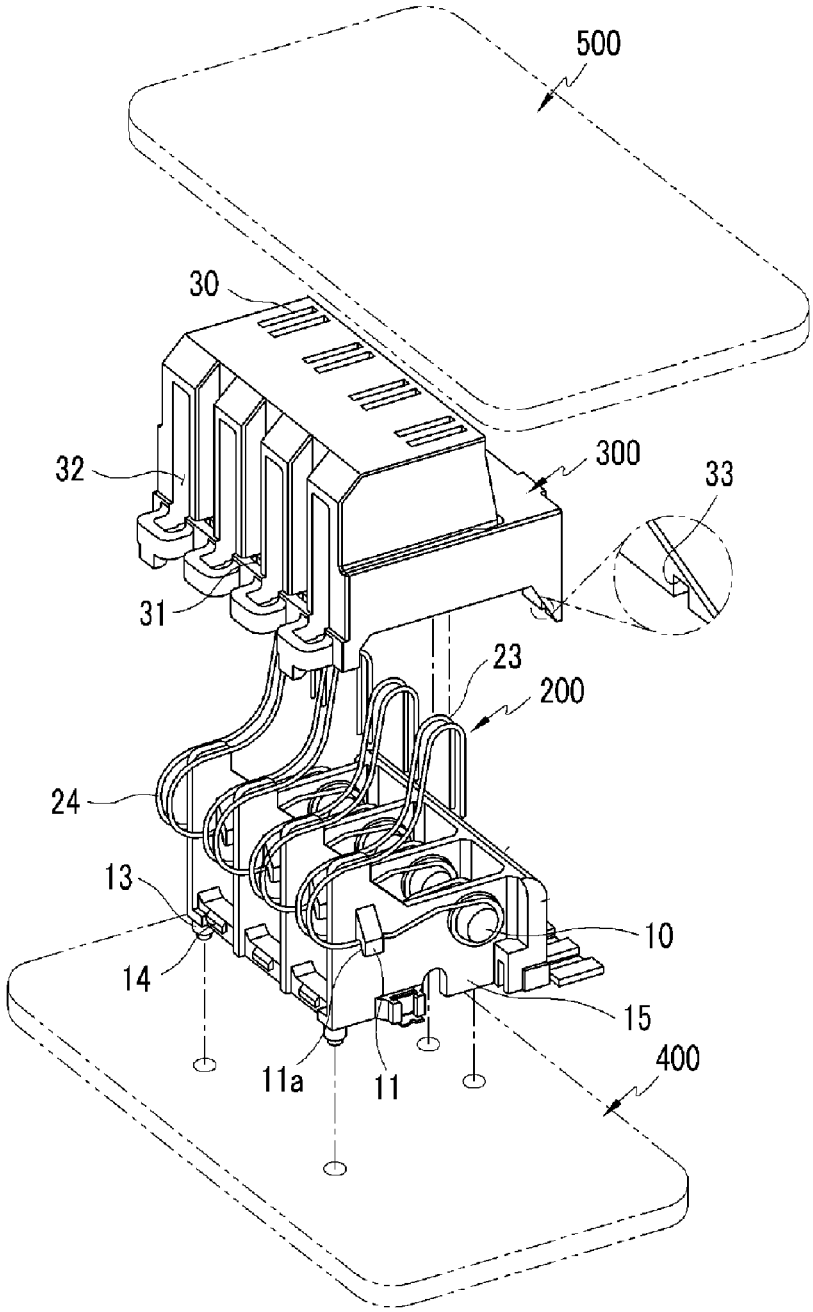

[Fig. 3]
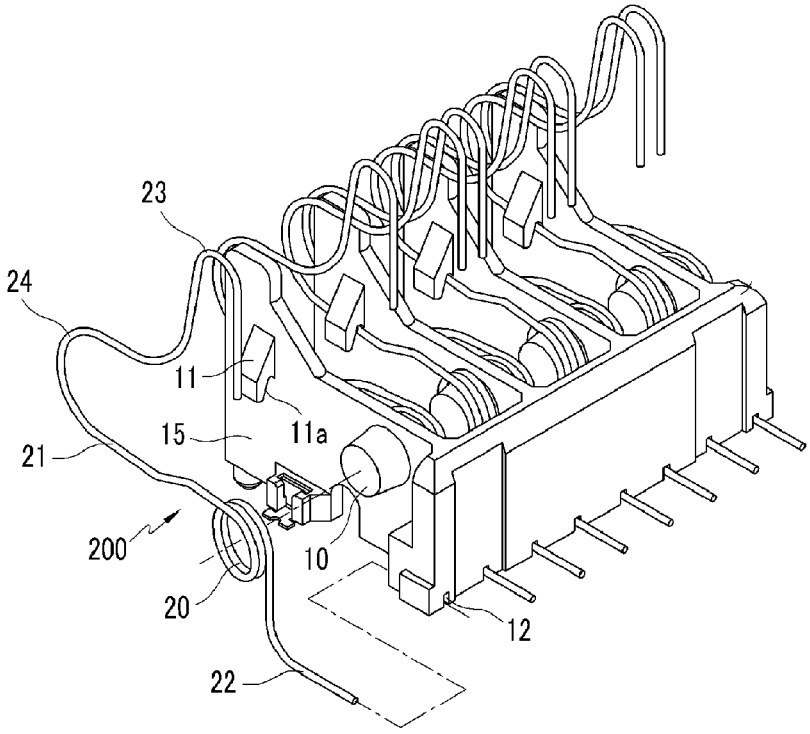
[Fig. 4]
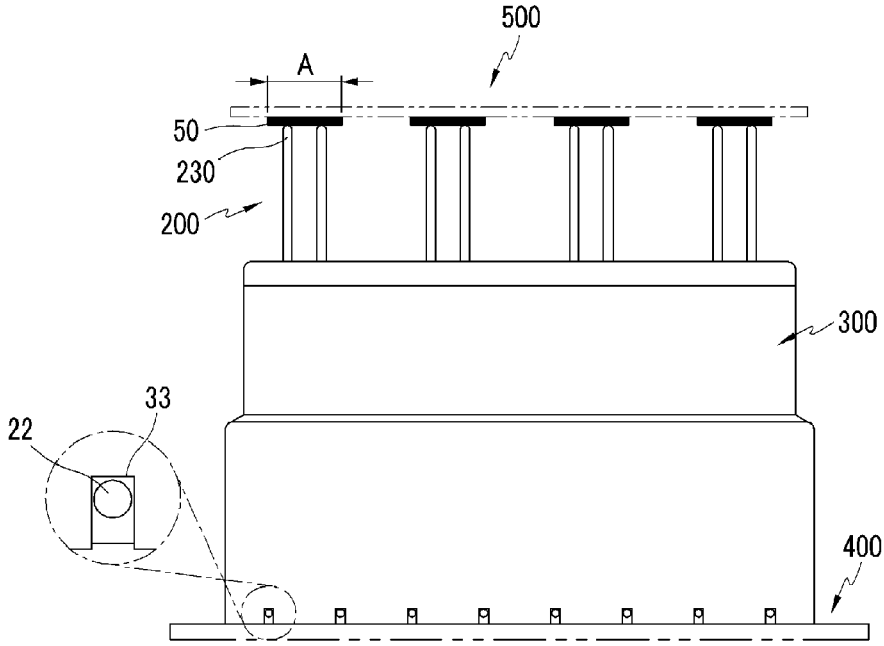

[Fig. 5]
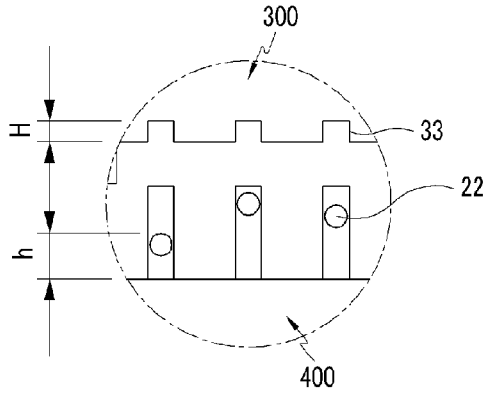
[Fig. 6]
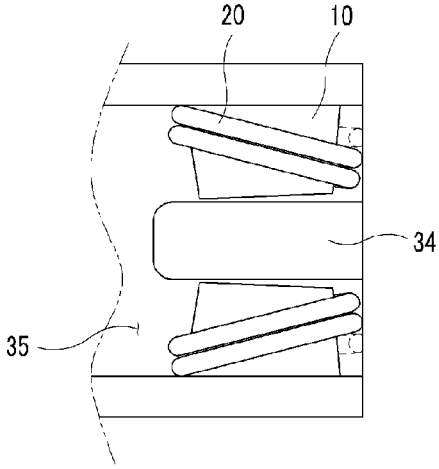
[Fig. 7]
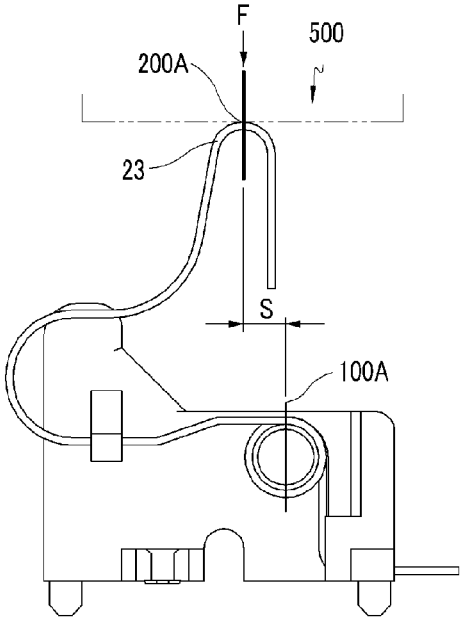

[Fig. 8]
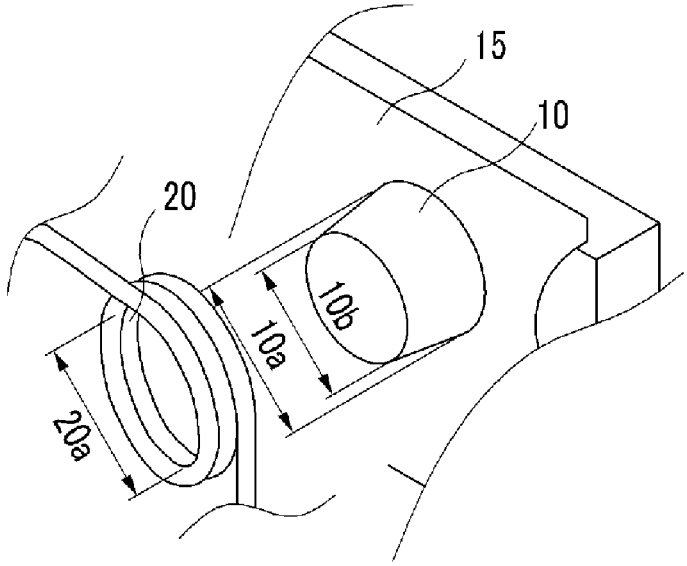
[Fig. 9]
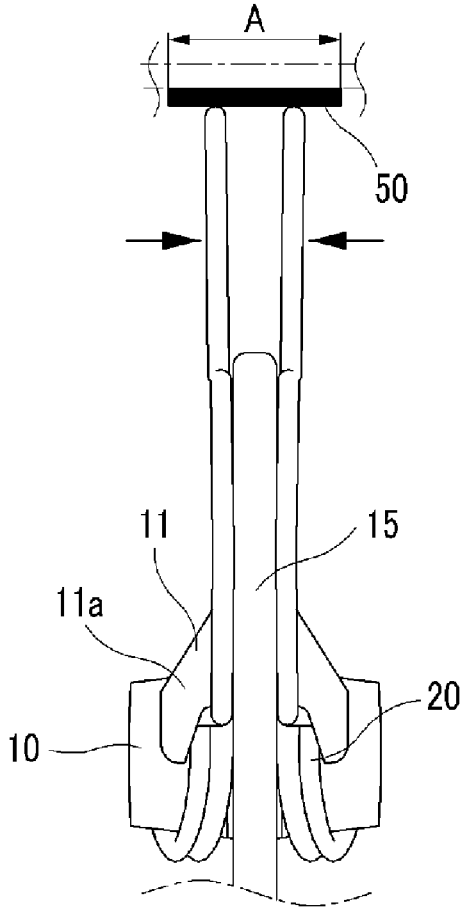

PRINTER INK CARTRIDGE TYPE CONNECTOR

TECHNICAL FIELD

The present invention relates to an electrical connector, and more particularly, to an electrical connector for a printer ink cartridge which can improve a connection force by changing a shape and material of a connection terminal, as well as reduce a soldering defect rate and improve assemblability by changing a shape and assembly structure of a housing and cover.

BACKGROUND ART

An electrical connector generally denotes a connection appliance for electrically connecting electric wires, circuits, devices, or a combination thereof. That is, the electrical connector connects two or more objects to each other to achieve the desired result of electric transmission as electrical appliances.

The electrical connector is a component that can be disposed at an end of the electric wire to repeatedly connect and disconnect electricity. With the progress of civilization, information communication products such as a computer, an automobile, and an electric home appliance are being invented and developed. Accordingly, the electrical connector serves as a high-speed connection system in addition to the normal function in which operates a machine through the electric transmission. Thus, the electrical connector has a significant effect on performance of the machine, and is widely used for the electrical appliances that can be operated by using the electricity.

The electrical connector can be easily assembled in itself to simplify a manufacturing process of an electronic product. Also, the electrical connector can allow a broken-down component of the electronic product to easily replace a now component, thereby easily maintaining and repairing the electronic product. In addition, the electrical connector connects the new component to an existing system to allow an engineer to easily design the electronic product.

A general structure of the electrical connector will now be described. The electrical connector commonly includes a connection terminal including connectors (portions of the connection terminal connected to an external printed circuit board) and a body for protecting the connector and the connection terminal.

The connection terminal is an electrically connected portion for performing a function of the electrical connector. Since the connection terminal must be electrically connected, the connection terminal is formed of a metal material to conduct the electricity.

The connection terminal is divided into a female part and a male part according to their shapes. Also, the two parts must be coupled to each other in order to perform a function thereof. The parts are accurately engaged to smoothly conduct the electricity.

The female part is called a socket connector, and the male part is called a pin connector. The socket connector and the pin connector are inserted into the electrical connector to conduct the electricity when the electrical connector is coupled.

The body serving as a cloth of the connection terminal protects the connection terminal against external environments such as pressure, heat, and cutting to smoothly perform the electrical connection that is a proper function of the connection terminal. Also, the body performs an insulation function in order to prevent the electrical connection portion from being electrically shorted with another connection portion.

Thus, the body is formed of a resin such as a plastic that is representative insulation material. The body includes a cover and a housing which are engaged with each other. The cover and the housing are coupled to each other to constitute the body.

A conventional electrical connector for a printer ink cartridge has a various contact types and shapes. When the ink cartridge is frequently inserted and withdrawn into/from the electrical connector, a connection terminal of the electrical connector is pushed in an upward or downward direction and a left or right direction. As a result, a fatigue load is generated in the connection terminal of the electrical connector, and thus, the connector of the connection terminal are depressed to change their shapes. Also, a restoring force of the connection terminal manufactured using a general press molding process is easily lost. In addition, due to various structural facts with respect to the electrical connector, a connection defect of the electrical connector frequently occurs.

The conventional electrical connector for the printer ink cartridge has various connection types and various shapes of the connector. Since the connection terminal is generally manufactured by bending a plate spring, the restoring force of the connection terminal is reduced by up/down/right/left movements and an impact strength of an object to be connected when the connection terminal is connected to the object such as a socket or the cartridge, thereby frequently causing the connection defect. Also, an assembly defect between the connection terminal and the connector housing frequently causes. In addition, the socket connector of the connection terminal is frequently separated from the connection terminal.

DISCLOSURE OF INVENTION

Technical Problem

An object of the present invention is to provide an electrical connector that can improve a restoring force of a connection terminal by replacing the connection terminal of the electrical connector with a torsion spring and prevent a connection defect and an assembly defect by changing a shape of the connection terminal of the electrical connector and an assembly structure of the electrical connector.

Technical Solution

An object of the present invention is to provide an electrical connector for a print ink cartridge, the electrical connector including: a housing including: a thin protrusion having a rectangle shape on one side portion thereof; a plurality of pin grooves spaced apart predetermined intervals from each in one side lower portion of the protrusion; a plurality of format ribs spaced apart predetermined intervals from each other in the other side of the protrusion; and coupling bosses having a wedge shape separately protruding on both sides of each of the ribs; a connection terminal serving as a torsion spring, the connecting terminal including: a pin connector inserted into each of the pin grooves of the housing and fixed in a straight line orientation; a wound coupling insert fitted onto each of the coupling bosses to give elasticity thereto; a parallel extending from the coupling insert and along each of the ribs; a bend bent at a front end of the parallel; and a socket connector bent in a state where the socket connector is connected to the bend, the socket connector being connected to an external socket; and a cover integrally fixed to the housing by a plurality of coupling hooks disposed on the housing, the cover including pine connector grooves pressing the pin connector of the coupling terminal in a downward direction in a side surface of the cover.

In an embodiment, the housing may include a stopping jaw on left and right surfaces of the each of the ribs, and the parallel of the connection terminal may be inserted and fixed into/to the stopping jaw.

In another embodiment, when the connection terminal is connected to an external socket, a pair of connection terminals may be connected to a terminal connection portion to provide a double contact structure.

In further embodiment, the connection terminal may be perpendicular to a coupling central position of the coupling insert fitted onto each of the coupling bosses of the housing and a contact position of the socket connector connected to the terminal connection portion of the socket.

In further another embodiment, the cover may include a partition within an inner space thereof, and the partition blocks between the coupling bosses of the housing.

Advantageous Effects

As described above, in the electrical connector for the print ink cartridge according to the present invention, a turning radius rarely occurs by changing the shape of the connection terminal and an assembly method. Thus, when the connection terminal is connected to the socket, the left and right movements of the socket connector of the connection terminal does not occur in a pushed direction, but only a vertical movement is allowed. Therefore, the connection terminal can be prevented from being separated from a contact surface of the socket to prevent the connection defect. In addition, a contact area of the socket can be reduced by a size ranging from a contact point of the socket connector to a tolerant range to reduce the material cost.

Also, the wedge type coupling boss and the connection terminal stopping jaw can be provided in the housing to improve the assemblability of the housing and the connection terminal and reduce the connection defect of the housing and the socket.

Also, the socket connector groove and a flat surface mounting region can be provided at an upper side surface of the cover to improve the assemblability. In addition, the pin connector groove can be provided in a bottom surface of the cover to prevent the soldering defect of the pin connector of the connection terminal.

BRIEF DESCRIPTION OF THE DRAWINGS

FIG. 1 is a perspective view of an electrical connector for a print ink cartridge according to the present invention.

FIG. 2 is an exploded perspective view of the electrical connector for the print ink cartridge according to the present invention.

FIG. 3 is a perspective view illustrating a connection terminal and a housing of the electrical connector for the print ink cartridge according to the present invention.

FIG. 4 is a front view illustrating a structure of the electrical connector for the print ink cartridge according to the present invention.

FIG. 5 is a partially detailed view illustrating a cover and the housing of the electrical connector for the print ink cartridge according to the present invention.

FIG. 6 is a partially bottom view of the electrical connector for the print ink cartridge according to the present invention.

FIG. 7 is a side view illustrating the connection terminal and the housing of the electrical connector for the print ink cartridge according to the present invention.

FIG. 8 is a detailed perspective view illustrating an assembled state of the connection terminal and the housing of the electrical connector for the print ink cartridge according to the present invention.

FIG. 9 is a detailed side view illustrating the assembled state of the connection terminal and the housing of the electrical connector for the print ink cartridge according to the present invention.

MODE FOR THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Hereinafter, the present invention will be described with reference to the accompanying drawings.

Referring to FIGS. 1 and 2, an electrical connector according to the present invention includes a housing 100, connection terminals 200, and a cover 300.

The housing 100 include four ribs 15, and a pair of coupling bosses 10 respectively disposed on left/right surfaces of each of the ribs 15. Thus, total eight coupling bosses 10 are provided. Four fixing bosses 13 is provided on a bottom surface of the housing 100 to fix the electrical connector to a printed circuit board 400.

Although the four ribs 15 are provided in an embodiment, the present invention is not limited thereto. For example, various numbers of ribs may be provided according to an apparatus in which the electrical connector of the present invention is applied. The pair of coupling bosses 10 is provided on the both surfaces the each of the ribs 15.

Each of the connection terminal 200 includes a coupling insert 20, a parallel 21, a bend 24, a socket connector 23, and a pin connector 22. The coupling insert 20 having a spirally wound shape is assembled to the coupling bosses 10 of the housing 100. The parallel 21 is connected in a left direction of tangential extension of the coupling insert 20 and coupled to a stopping jaw 11 of the housing 100. The bend 24 is connected to a front end of the parallel 21 and bent into an U-shape protruding in a left direction. The socket connector 23 is connected in a right direction of a tangent straight line of the bend 24, bent into an U-shape protruding in an upward direction, and connected to a terminal 50 of a socket 500. The pin connector 22 is straightly extended from the coupling insert 20 in a downward direction, bent into a predetermined circular arc shape in a right direction, connected in a tangent straight line direction of the bent circular arc shape, and connected to printed circuit board 400. The electrical connector according to the present invention includes eight connection terminals.

The cover 300 has connector holes 30, three coupling hook grooves 31, and four bending grooves 32. The connector holes 30 having a rectangular shape are disposed in a top surface of the cover 300. Two connector holes 30 which are adjacent to each other make a pair. Other pairs of connector holes 30 are arranged at a relatively long distance from the pair of connector holes 30. The socket connector 23 of the connection terminal 100 is inserted into the each of the connector holes 30. The coupling hook grooves 31 are disposed in a side surface of the cover 300, which is perpendicular to the top surface of the cover 300. Each of the coupling hook grooves 31 is coupled to the a coupling hook 14 of the housing 100. The bending grooves having a rectangular shape are disposed at positions spaced apart a predetermined distance on the side surface of the cover 300.

A process of assembling components of the electrical connector according to the present invention will be described with reference to FIG. 3 illustrating a perspective view of the connection terminal 200 and the housing 100 which are assembled to each other and FIG. 2 illustrating an exploded perspective view of the electrical connector according to the present invention.

In the assembly process, the housing 100 and the connection terminal 200 are assembled in sequence according to the following processes (a), (b) and (c) with reference to FIG. 3.

(a) The pin connector 22 of the connection terminal 200 is inserted into a pin groove 12 of the housing 100. The pin connector 22 of the connection terminal 200 is fixed by pulling the pin connector 22 of the connection terminal 200 by a predetermined length in a front direction after a central portion of each coupling boss 10 of the housing approximately corresponds to a central portion of the coupling insert 20 of the connection terminal 200.

(b) The coupling insert 20 of the connection terminal 200 is fitted onto the coupling boss 10 of the housing 100. The coupling insert 20 is pushed and in contact with each of the coupling bosses 10. The coupling insert 20 is inserted until the connection terminal 200 is fixed.

(c) The parallel 21 disposed in the same straight line along the connection terminal 200 is pushed to an inner surface 11*a* of the stopping jaw 11 of the housing 100 to complete the coupling process.

Other connection terminals 200 are coupled using the same process as described above to complete the assembly of the connection terminals 200.

Also, a process of assembling the cover 300 to the housing 100 and the connection terminal 200 will now be described with reference to FIG. 2. The process is performed in sequence according to the following processes (a), (b) and (c).

(a) The socket connector 23 of the connection terminal 200 is aligned and inserted with/into the connector holes 30 of the cover 300.

(b) A pair of bends aligned adjacent to each other of the connection terminal 200 is aligned and inserted with/into one bending groove 32 disposed in the side surface of the cover 300.

(c) The coupling hook 14 of the housing 100 is inserted into one coupling hook groove 31 of the cover 300 to complete the coupling process, and the cover is fixed to the housing 100.

Functional characteristics of the assembly structure of the electrical connector according to the present invention will be described in detail. Referring to FIG. 4, the socket connector 23 of the connection terminal 200 is disposed at a predetermined height with respect to the flat top surface of the cover 300. Two socket connectors 23 are connected to the same socket terminal 50 of the socket 500. The terminal 50 of the socket 500 is in contact with a pair of socket connectors 23 of the connection terminal 200 to provide a double contact structure. Thus, connection reliability of the electrical connector can be improved. Although one socket connector 23 of the connection terminal 200 is not connected, an error of the electrical connector due to non-connection of one socket connector 23 can be reduced because the other socket connector 23 is connected.

The connection terminals 200 have the same number as pin connector grooves 33 having a rectangular shape in the cover 300. Thus, the pin connector 22 of the connection terminal 200 is maintained at a predetermined height with respect to the printed circuit board by pressing the pin connector 22 of the connection terminal 200 in a downward direction. Thus, a flatness of the pin connector 22 of the connection terminal 200 is improved, and a defect caused when the pin connector 22 of the connection terminal 200 is soldered to the pin connector grooves 33 can be reduced.

Furthermore, as illustrated in FIG. 5, a height of each of the pin connector grooves 33 of the cover 300 is less than a minimum height h of the pin connector 22 of the connection terminal 200. When the cover 300 is coupled to the housing 100, the pin connectors 22 having uneven heights with respect to an external printed circuit board 400 are uniformly aligned with heights of the pin connector grooves 33.

Referring to FIG. 6, a partition 34 having a protruded rectangular shape is disposed in an internal space 35 of the cover 300. When the cover 300 is coupled to the housing 100, the partition 34 blocks a gap between the coupling bosses 10 disposed between the ribs 15 of the housing 100 to prevent the coupling insert 20 of the connection terminal 200 from being separated from each of the coupling bosses 10, thereby reducing an assembly defect.

FIG. 6 illustrates a state in which the connection terminal 200 is assembled to the housing 100.

Functional characteristics with respect to the assembly structure of the connection terminal 200 and the housing 100 will be described in detail with reference to FIG. 7. The coupling insert 20 of the connection terminal 200 is fitted onto the coupling boss 10 to minimize a distance S separated between a central position 100A of the coupling insert 20 and a connector contact position 200A of the socket 500. Thus, a couple of forces (=F*S) due to a coupling force of the socket 500 and the connection terminal 200 is not sufficiently generated.

Thus, left and right movements of the connection terminal 200 due to a movement of the socket 500 does not occur, but only a vertical movement is allowed. As a result, the connection reliability of the electrical connector is improved. In addition, since a width of the left and right movements of the connection terminal 200 is reduced, a terminal width A of the socket 500 can be small to reduce the material cost.

Referring to FIG. 8, the coupling boss 10 of the housing 100 has a wedge shape in which a diameter 10*a* of the coupling boss 10 on a rib surface 15 of the housing 100 is greater than a diameter 10*b* on a free end of the coupling boss 10. Since an internal diameter 20*a* of the coupling insert 20 of the connection terminal 200 is greater than the diameter 10*b* on the free end, the coupling insert 20 can be easily fitted onto the coupling boss 10, thereby improving assemblability. A gap is generated by a difference between the internal diameter 20*a* of the coupling insert 20 of the connection terminal 200 and the diameter 10*b* on the free end of the coupling boss 10 of the housing 100 to connect the connection terminal 200 to the socket 500. Although the coupling insert 20 of the connection terminal 200 shrinks by a generated external force, it does not have an effect on the coupling boss 10 of the housing 100, thereby providing a further stable structure.

Referring to FIG. 9, the connection terminal 200 is closely adhered toward the rib 15 of the housing 100 due to the inner surface 11*a* of the stopping jaw 11 of the housing 100. Thus, the pair of socket connectors 23 of the connection terminal 200 can become narrow in arrow directions to reduce the terminal width A of the socket 500.

The connection terminal 200 is fixed over the inner surface 11*a* of the stopping jaw 11 of the housing 100 to uniformly maintain the height of the socket connector 23 of the connection terminal 200. Therefore, reliability of contact points of the electrical connector can be improved. Also, the connection terminal 200 is fixed inside the inner surface 11*a* of the stopping jaw 11 to prevent the connection terminal 200 from being separated.

While the present invention has been particularly shown and described with reference to exemplary embodiments thereof, it will be understood by those of ordinary skill in the art that the present invention covers the modifications and variations of this invention provided they come within the scope of the appended claims and their equivalents.

The invention claimed is:

1. An electrical connector for a print ink cartridge, comprising:

a housing including:

a thin protrusion having a rectangle shape on one side portion thereof;

a plurality of pin grooves spaced apart predetermined intervals from each in one side lower portion of the protrusion;

a plurality of format ribs spaced apart predetermined intervals from each other in the other side of the protrusion; and coupling bosses having a wedge shape separately protruding on both sides of each of the ribs;

a connection terminal serving as a torsion spring, the connecting terminal including:

a pin connector inserted into each of the pin grooves of the housing and fixed in a straight line orientation;

a wound coupling insert fitted into each of the coupling bosses to give elasticity thereto;

a parallel extending from the coupling insert and along each of the ribs;

a bend bent at a front end of the parallel; and a socket connector bent in a state where the socket connector is connected to the bend, the socket connector being connected to an external socket; and a cover integrally fixed to the housing by a plurality of coupling hooks disposed on the housing, the cover including pin connector grooves pressing the pin connector of the coupling terminal in a downward direction in a side surface of the cover.

2. The electrical connector for the print ink cartridge of claim 1, wherein the housing includes a stopping jaw on left and right surfaces of the each of the ribs, and the parallel of the connection terminal is inserted and fixed into/to the stopping jaw.

3. The electrical connector for the print ink cartridge of claim 1, wherein, when the connection terminal is connected to an external socket, a pair of connection terminals is connected to a terminal connection portion to provide a double contact structure.

4. The electrical connector for the print ink cartridge of claim 1, wherein the connection terminal is perpendicular to a coupling central position of the coupling insert fitted onto each of the coupling bosses of the housing and a contact position of the socket connector connected to the terminal connection portion of the socket.

5. The electrical connector for the print ink cartridge of claim 1, wherein the cover includes a partition within an inner space thereof, and the partition blocks between the coupling bosses of the housing.

6. The electrical connector for the print ink cartridge of claim 1, wherein when the cover is coupled to the housing, a height H of each of the pin connector grooves of the cover is less than a minimum height h of the pin connector from an external printed circuit board, and the pin connector is aligned at the same height as the height H of each of the pin connector grooves to provide the pin connector having an uniform flatness.

* * * * *